US006976319B2

(12) United States Patent
Pfander

(10) Patent No.: US 6,976,319 B2
(45) **Date of Patent: *Dec. 20, 2005**

(54) FOOTWEAR CONSTRUCTION

(75) Inventor: Wilhelm F. Pfander, Brewer, ME (US)

(73) Assignee: Phoenix Footwear Group, Inc., Old Town, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/950,513

(22) Filed: Sep. 28, 2004

(65) Prior Publication Data

US 2005/0044745 A1 Mar. 3, 2005

Related U.S. Application Data

(63) Continuation of application No. 10/431,637, filed on May 5, 2003, now Pat. No. 6,857,202.

(51) Int. Cl.[7] ..... A43B 13/38
(52) U.S. Cl. ..... 36/3 R; 36/3 B; 36/30 R
(58) Field of Search ..... 36/3 R, 3 B, 25 R, 36/30 R, 28, 29, 141

(56) References Cited

U.S. PATENT DOCUMENTS

| | | | |
|---|---|---|---|
| 1,653,059 | A | 12/1927 | Nelson |
| 1,870,114 | A | 8/1932 | Heller |
| 2,090,881 | A | 8/1937 | Wilson |
| 3,256,621 | A | 6/1966 | Linton |
| 3,533,171 | A | 10/1970 | Motoki |
| 4,223,456 | A | 9/1980 | Cohen |
| 4,274,211 | A | 6/1981 | Funck |
| 4,547,978 | A | 10/1985 | Radford |
| 4,619,055 | A | 10/1986 | Davidson |
| D315,634 | S | 3/1991 | Yung-Mao |
| 5,369,896 | A | 12/1994 | Frachey et al. |
| 5,400,526 | A | 3/1995 | Sessa |
| 5,619,809 | A | 4/1997 | Sessa |
| 5,655,314 | A | 8/1997 | Petracci |
| 5,675,914 | A | 10/1997 | Cintron |
| 5,718,063 | A | 2/1998 | Yamashita et al. |
| 5,753,061 | A | 5/1998 | Rudy |
| D399,040 | S | 10/1998 | Merceron |
| 5,983,524 | A | 11/1999 | Polegato |
| 5,992,052 | A | 11/1999 | Moretti |
| 6,029,962 | A | 2/2000 | Shorten et al. |
| 6,178,662 | B1 | 1/2001 | Legatzke |
| 6,205,680 | B1 | 3/2001 | Clark |
| 6,209,226 | B1 | 4/2001 | Squadroni |
| 6,675,501 | B2 * | 1/2004 | Pfander ..... 36/28 |

(Continued)

*Primary Examiner*—M. D. Patterson
(74) *Attorney, Agent, or Firm*—Nixon & Vanderhye P.C.

(57) ABSTRACT

A footwear construction comprising a flexible and resilient outsole having a front portion with a plurality of depending moguls on the bottom surface thereof. A midsole is positioned over the outsole and has a front portion with a plurality of spaced holes therethrough which are substantially vertically aligned with some or all of the moguls to enable air flow through the midsole when the moguls are deformed by the weight and walking action of the wearer. A footbed is positioned over the midsole and comprises a soft flexible and resilient body member having a plurality of spaced, raised cushioning elements on the upper surface thereof. The footbed has a front portion with a plurality of spaced apertures therethrough which are substantially vertically aligned with some or all of the holes in the midsole to enable air flow through the body member. An upper extends over the footbed and midsole, and is secured to the outsole.

12 Claims, 8 Drawing Sheets

U.S. PATENT DOCUMENTS

| | | | | |
|---|---|---|---|---|
| 6,857,202 | B2 * | 2/2005 | Pfander | 36/3 R |
| 6,922,914 | B2 * | 8/2005 | Pfander | 36/28 |
| 2001/0010128 | A1 | 8/2001 | Bray et al. | |
| 2002/0092207 | A1 | 7/2002 | Girard et al. | |
| 2003/0150131 | A1 | 8/2003 | McManus et al. | |
| 2004/0103559 | A1 | 6/2004 | Pfander | |

* cited by examiner

FOOTWEAR CONSTRUCTION

This application is a Continuation of application Ser No. 10/431,637 filed May 5, 2003, now U.S. Pat. No. 6,857,202 the entire content of which is hereby incorporated herein by reference to this application.

BACKGROUND

The present invention relates generally to a footwear construction and, more particularly, to such a construction which provides increased comfort and support for the foot of the wearer.

Recent efforts to provide footwear for walking which is both comfortable and anatomically beneficial to the wearer have resulted in many concepts having varying degrees of effectiveness. Most of these concepts are merely variations of other concepts which have been around for years. Historically, there have been a number of attempts to increase the cushioning and support of footwear by making modifications to the outsole, insole or midsole. These attempts have been subject to one or more of the following disadvantages:

1. They have been complicated in construction;
2. They have been difficult to manufacture;
3. They have been expensive to manufacture;
4. They have not been durable;
5. They have not been sufficiently comfortable; and,
6. They have not provided adequate support and stability for the foot of the wearer.

The footwear construction of the present invention is not subject to any of the above listed disadvantages and provides advantages which have not been achieved in prior footwear constructions.

SUMMARY OF THE INVENTION

The footwear construction of the present invention comprises an outsole formed of a suitable flexible and resilient material having a honeycomb construction in the mid to toe or front portion thereof. The honeycomb construction comprises upstanding ribs on the upper surface of the outsole which extend between a plurality of spaced, depending protrusions or moguls that provide shock absorption and draw fresh air into the footwear in a manner to be more fully explained hereinafter. The heel portion of the outsole also comprises spaced, depending moguls and may be recessed in the upper surface thereof to receive therein a plug formed of a suitable material for superior shock absorption. The outsole also includes an upstanding rim to provide a recessed area for the positioning therein of a midsole and a footbed.

The midsole is formed of a suitable material in the front portion thereof that wicks away moisture, such as felt. A plurality of spaced holes are provided through the front portion of the midsole that are generally aligned with some of the moguls in the outsole for the purpose of providing air flow through the midsole when the moguls are deformed by the weight and walking action of the wearer. The rear or heel portion of the midsole is formed of an increased thickness, laminated construction and has embedded therein for support an elongated shank or the like formed of steel or another suitable substantially rigid material. The shank preferably extends from the heel portion forwardly to a point just behind the ball of the foot of the wearer such that there will be a rocking action during walking of the portions of the outsole and midsole adjacent to the shank.

The footbed is formed of a body member of a relatively soft material or foam such as polyurethane foam and having a plurality of upstanding, spaced raised portions or cushioning elements on the upper surface thereof, and a flexible cover member which surrounds the body member and extends below and is secured thereto to provide a unitary construction. The front portion of the footbed is provided with a plurality of spaced apertures therethrough which are generally aligned with the holes in the midsole to allow air flow from the moguls in the outsole, through the midsole and through the footbed to the foot of the wearer.

The body member of the footbed preferably is formed of a polyurethane foam that is relatively soft in the nature of foam used for a mattress, upholstered chair or the like. In a preferred embodiment, the body member has a thickness of approximately 6 millimeters and the raised cushioning elements thereof are approximately 6 millimeters in height. The raised cushioning elements preferably are spaced approximately 10–30 millimeters from each other. Because of the flexibility, spacing and size of the raised cushioning elements, they provide enhanced comfort and support to the foot of the wearer and also are self-adjusting to the wearer's foot so that it does not slide on the footbed and thus is very stable when positioned thereon during walking or the like.

An upper formed of any suitable flexible material is secured to the outsole in any suitable manner. Preferably, the upper is formed of an outer layer, a lining of a fabric that wicks away moisture and suitable padding between the outer layer and the lining. The upper may be provided with elasticized laces that flex with foot movement for comfort and support.

DESCRIPTION OF THE PREFERRED EMBODIMENTS

Figure 1:
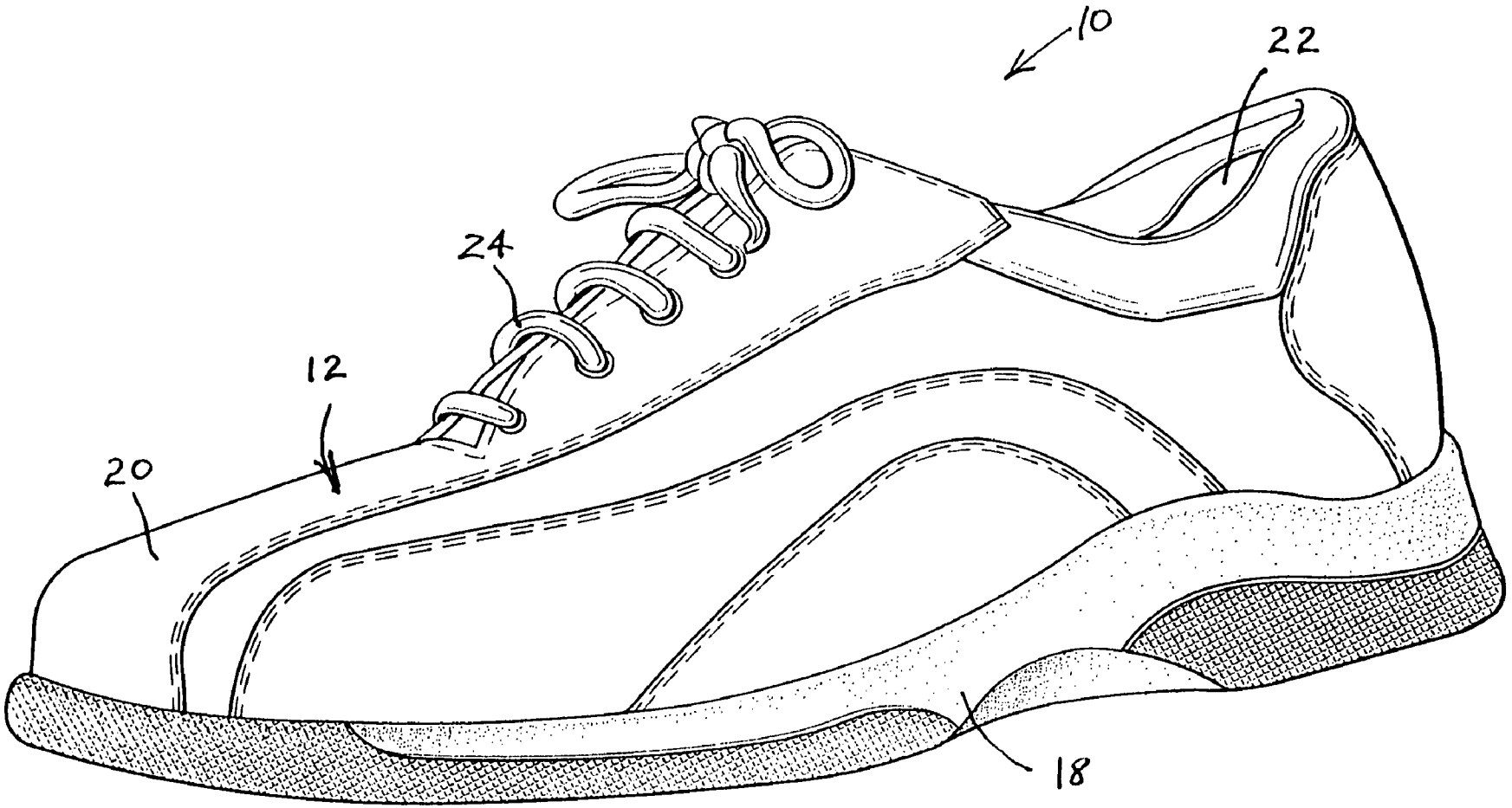
FIG. 1 is a perspective view of the footwear construction of the present invention.
Figure 2:
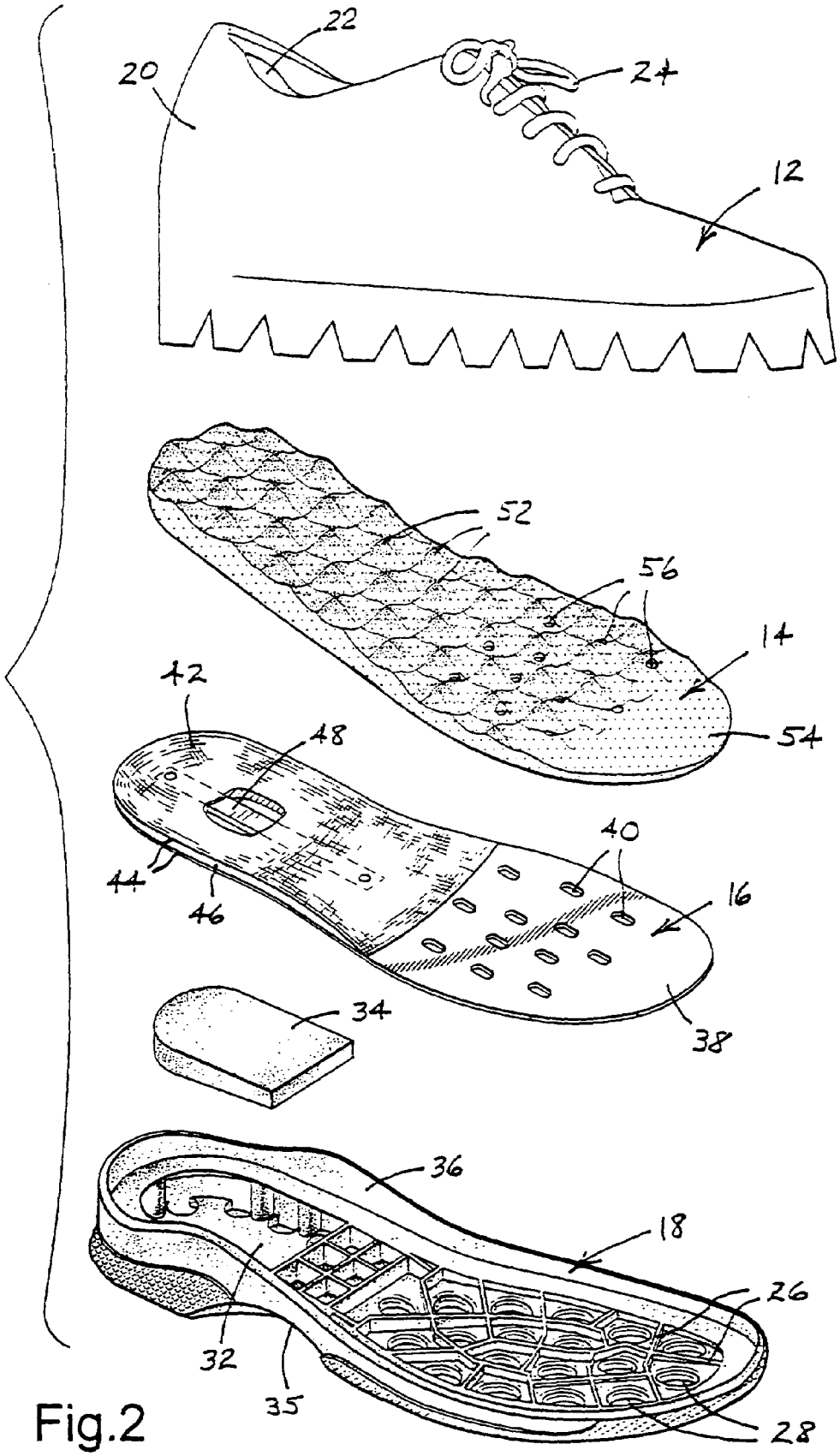
FIG. 2 is an exploded perspective view of the components of the footwear construction of the present invention.
Figure 3:
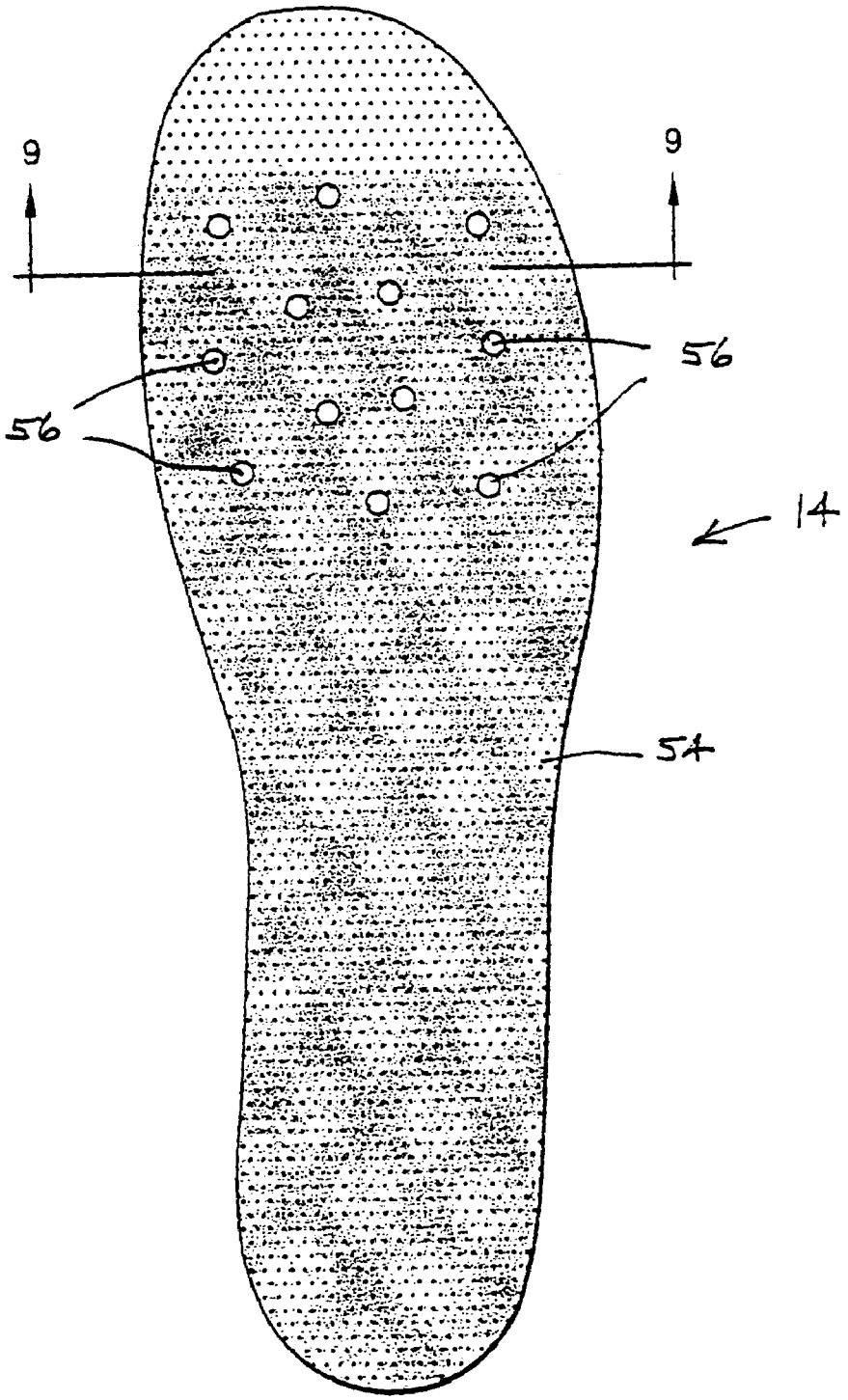
FIG. 3 is a top plan view of the footbed of the footwear construction.
Figure 4:
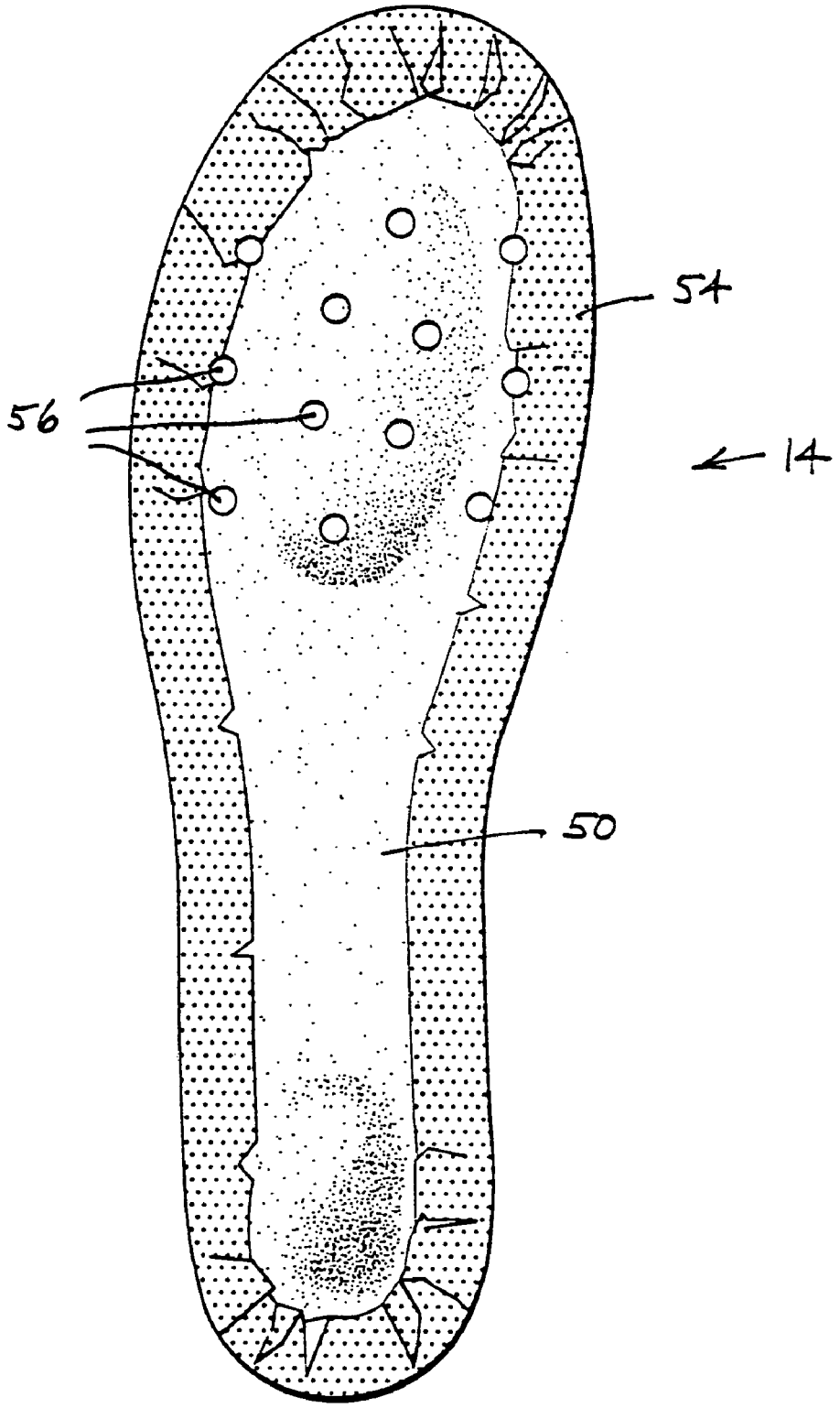
FIG. 4 is a bottom plan view of the footbed of the footwear construction.
Figure 5:
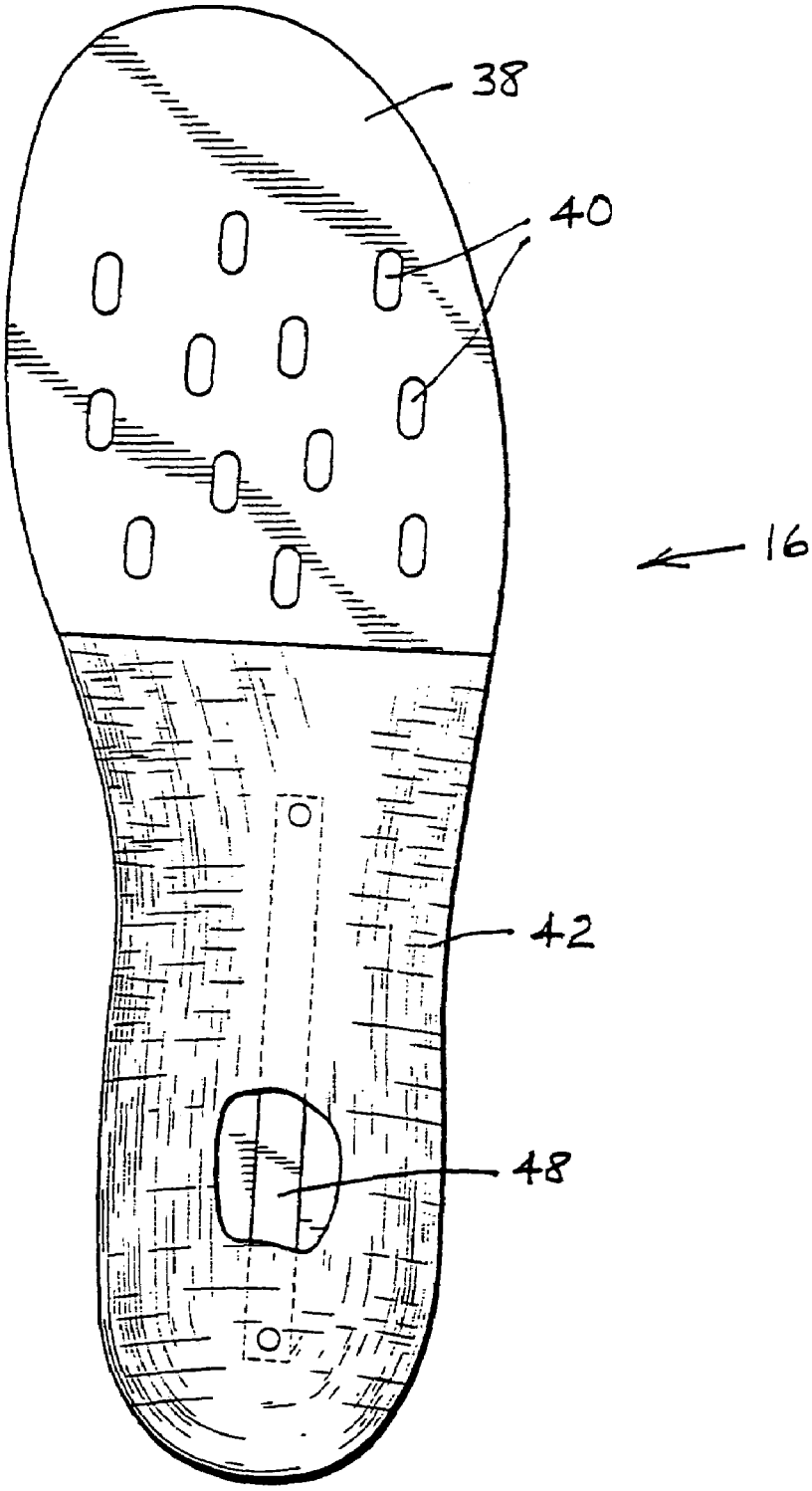
FIG. 5 is a top plan view of the midsole of the footwear construction, with parts broken away.
Figure 6:
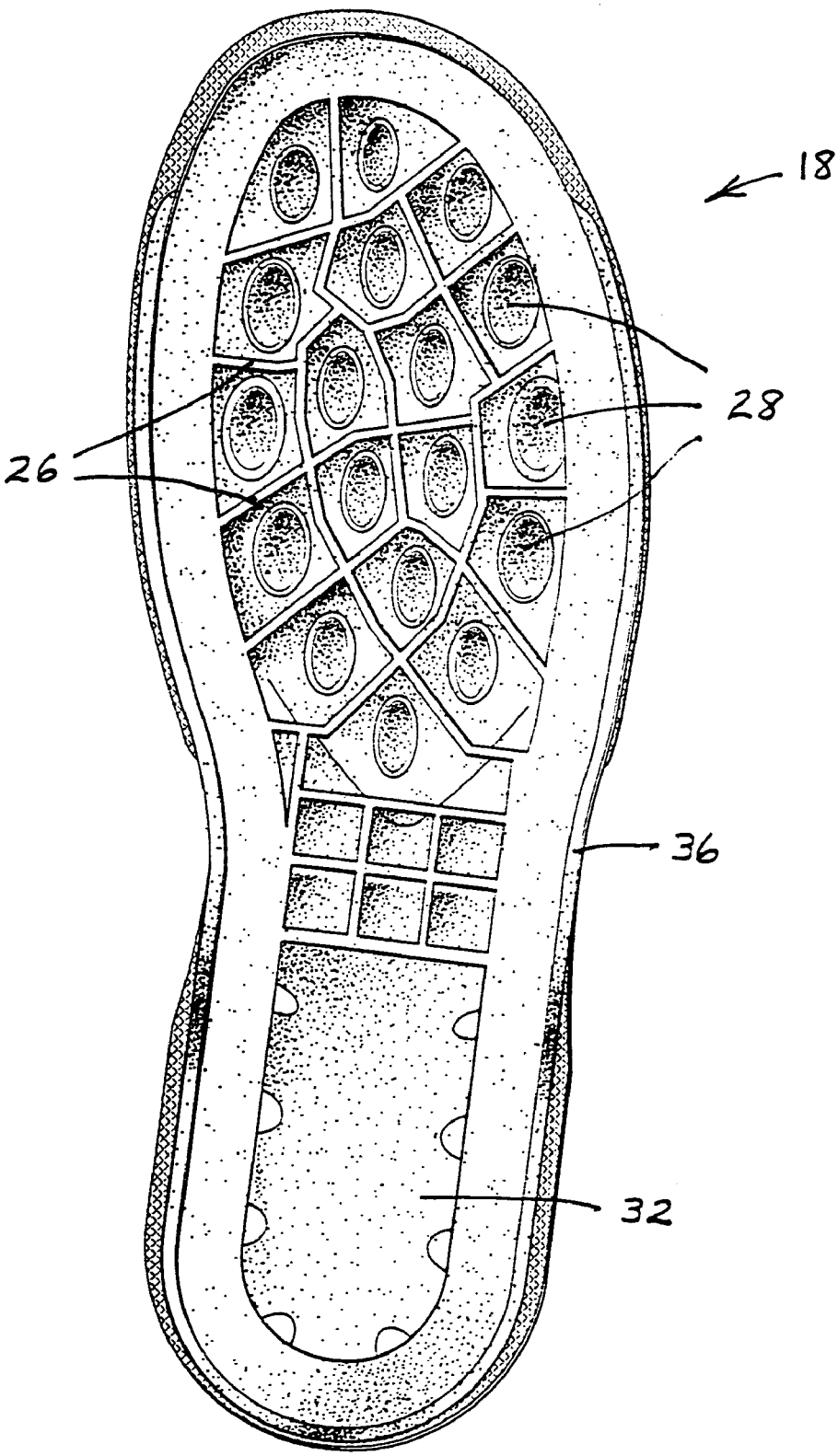
FIG. 6 is a top plan view of the outsole of the footwear construction.
Figure 7:
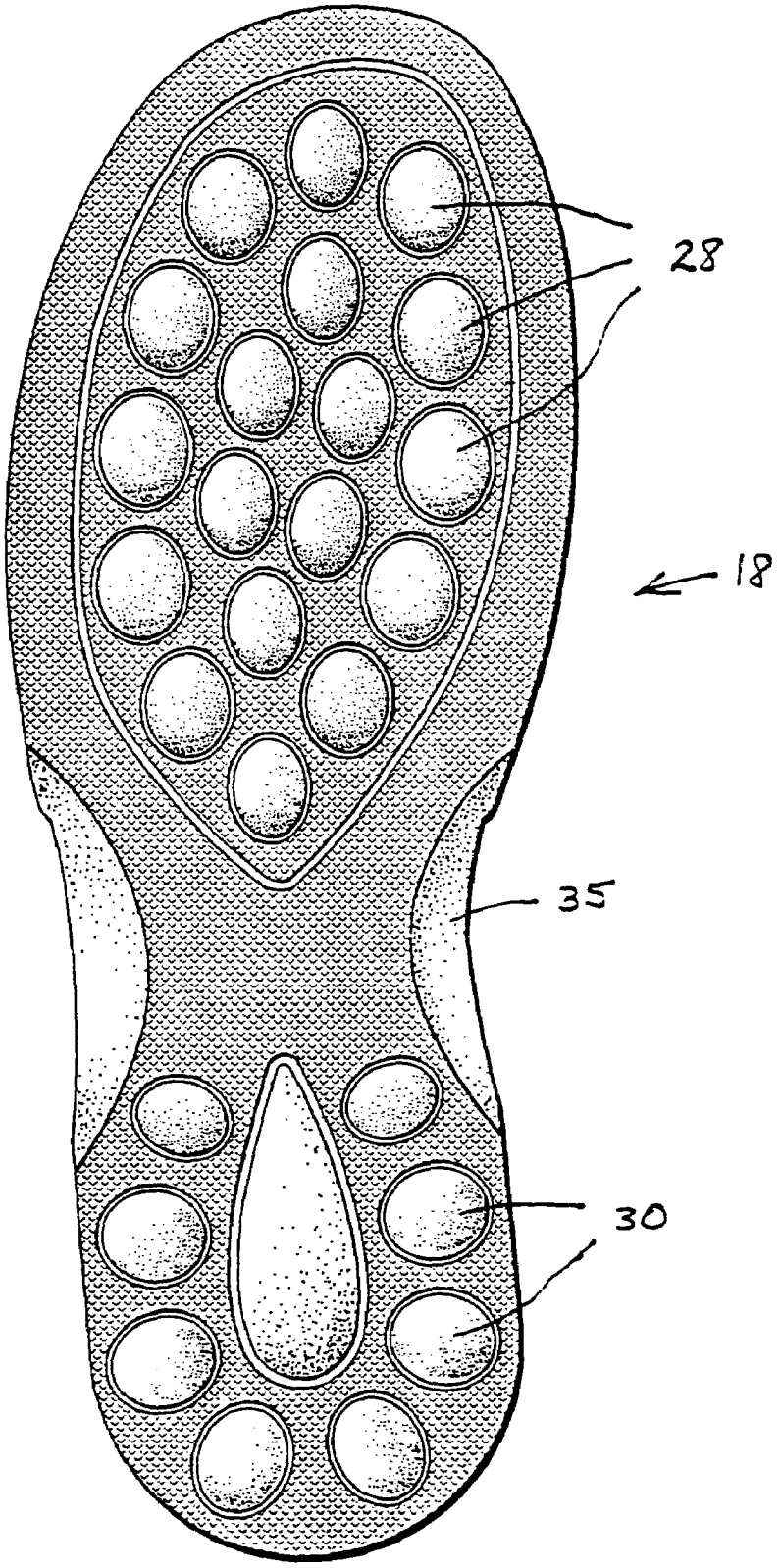
FIG. 7 is a bottom plan view of the outsole of the footwear construction.
Figure 8:
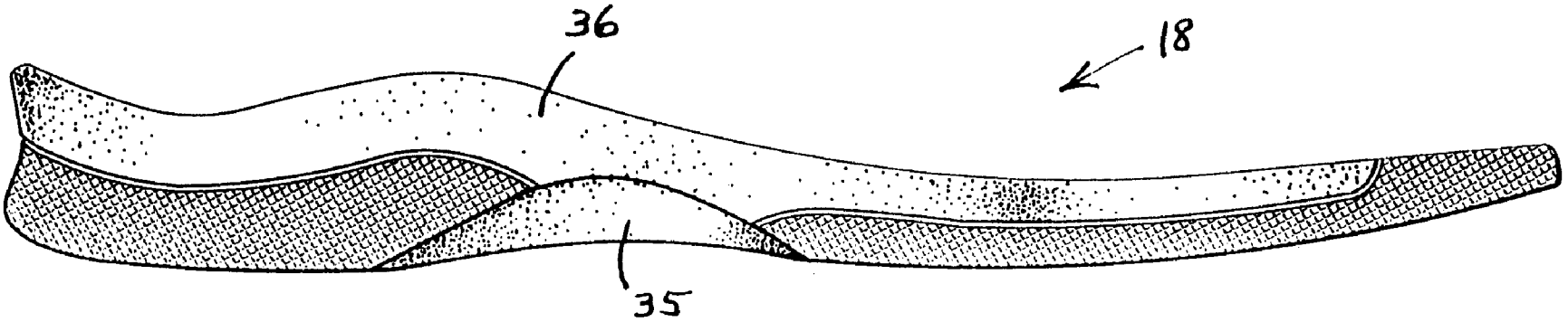
FIG. 8 is a side elevational view of the outsole of the footwear construction.

Referring to FIGS. 1 and 2, the new and improved footwear construction 10 of the present invention generally comprises an upper 12, a footbed 14, a midsole 16 and an outsole 18 which are secured together in any suitable manner such as by a suitable adhesive or the like.

The upper 12 may be formed of an outer layer 20 of any suitable flexible material such as leather or a synthetic material, and a lining 22 formed of a suitable fabric that serves to wick moisture away from the foot of the wearer. For additional softness and comfort, a padding of any suitable material may be provided between the outer layer 20 and lining 22. For additional comfort and support, the upper may be provided with elasticized laces 24 that flex with foot movement.

As shown in FIGS. 2 and 6–8, the outsole 18 is formed or molded of a suitable flexible and resilient material, such as polyurethane, and is of a honeycomb construction with upstanding ribs 26 on the upper surface thereof extending generally from the arch portion to the toe portion thereof. The ribs 26 extend between a plurality of spaced, depending protrusions or moguls 28 that provide shock absorption and draw fresh air into the footwear in a manner to be more fully explained hereinafter. The moguls 28 may be of any suitable size, shape, depth and spacing. As an illustrative example, the moguls are generally circular or elliptical in shape, have a width or diameter or approximately from 15 to 22 millimeters, are approximately from 4 to 12 millimeters in depth, are spaced approximately from 15 to 36 millimeters from each other, and are approximately from 2.5 to 4 millimeters in thickness.

The heel portion of the outsole 18 also comprises spaced, depending moguls 30 of any suitable size, shape, depth and configuration, which may be the same as or similar to the moguls 28. A recess 32 is provided in the upper surface of the outsole heel portion to receive therein a plug 34 formed of any suitable material for superior shock absorption in the heel area. In another embodiment, the plug 34 could be provided in a recess (not shown) in the heel portion of the midsole 16.

The outsole 18 also includes an arch portion 35 and an upstanding rim 36 of any suitable or desired size and shape which provides a recessed area for the positioning therein of the midsole 16 the footbed 14 and the lower portion of the upper 12.

The midsole 16 is formed of any suitable material, such as felt, in the front portion 38 thereof that serves to wick away moisture. A plurality of spaced holes 40 are provided through the front portion 38 of the midsole 16 that are generally aligned with some or all of the moguls 28 in the outsole 18 for the purpose of providing air flow through the midsole 16 when the moguls are deformed by the weight and walking action of the wearer. The rear or heel portion 42 of the midsole 16 is formed of an increased thickness, laminated construction that is secured to the front portion 38 in any suitable manner, such as by a suitable adhesive. As an illustrative example, the heel portion may be formed of thin outer layers 44 of a suitable material such as cotton, cellulose, and a thicker inner layer 46 formed of a suitable material such as paper. Preferably, a reinforcing member 48, such as a shank formed of steel or another substantially rigid material is embedded or provided in the inner layer 46 of the heel portion 42 and extends longitudinally substantially from the rear of the heel portion 42 forwardly to a point near the joint between the front portion 38 and heel portion 42 just behind the ball of the foot of the wearer. The reinforcing member 48 provides additional support in the heel and arch areas such that there will be a rocking action during walking of the portions of the outsole and midsole adjacent to the reinforcing member.

Figure 9:
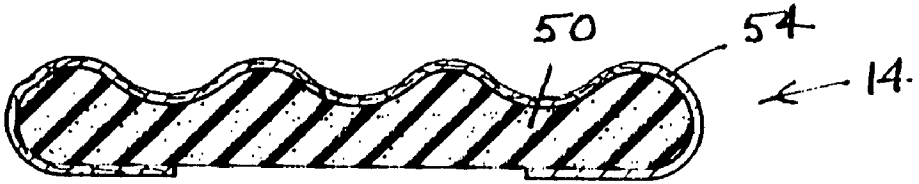
FIG. 9 is a sectional view of the footbed of the footwear construction taken substantially along line 9—9 in FIG. 3.

The footbed 14 comprises a body member 50 preferably formed of a soft flexible and resilient material or foam such as polyurethane foam that is relatively soft in the nature of the foam used for mattresses, upholstered furniture or the like. As shown in FIGS. 2 and 9, the body member 50 comprises a plurality of raised portions or cushioning elements 52 of generally curved shape on the upper surface thereof. Preferably, the body member is approximately 6 millimeters in thickness and the raised cushioning elements 52 are approximately 6 millimeters in height above the upper surface of the body member. Also, the raised cushioning elements 52 are substantially uniformly spaced on the body member 50 at a distance of approximately 10–30 millimeters from each other.

The footbed 14 further comprises a cover member 54 formed of any suitable flexible material such as leather and of any suitable construction. The cover member 54 may be provided with a plurality of small perforations therethrough for the purpose of enhancing the breathability thereof. The cover member 54 surrounds and conforms generally to the shape of the body member 50, and extends beneath and is secured to the lower surface of the body member in any suitable manner, such as by suitable adhesive.

The footbed 14 is provided with a plurality of spaced apertures 56 in the front portion thereof that extend through the cover member 54 and the body member 50. The apertures 56 are generally aligned with some or all of the holes 40 in the midsole 16 to allow air flow from the moguls 28 in the outsole 18, through the midsole 16 and through the footbed 14 to the foot of the wearer.

Referring to FIGS. 1 and 2, in the assembly of the footwear construction 10, the upper 12 extends around the midsole 16 and is secured to the midsole and to the outsole 18 in any suitable manner, such as by a suitable adhesive. The midsole 16 is secured to the outsole 18 in any suitable manner, such as by a suitable adhesive, and the footbed 14 is secured to the midsole 16 in any suitable manner, such as by a suitable adhesive.

It will be readily seen that the footwear construction 10 of the present invention, because of its unique construction, provides enhanced anatomical support, stability and comfort for the foot of the wearer and is an ideal walking shoe.

While the invention has been described in connection with what is presently considered to be the most practical and preferred embodiment, it is to be understood that the invention is not to be limited to the disclosed embodiments, but on the contrary, is intended to cover various modifications and equivalent arrangements included within the spirit and scope of the appended claims.

What is claimed is:

1. A footwear construction, comprising:

a flexible and resilient outsole having a front portion with a plurality of depending moguls on the bottom surface thereof;

a midsole positioned over said outsole and having a front portion with a plurality of spaced holes therethrough, said spaced holes being substantially vertically aligned with some or all of said moguls to enable air flow through said midsole when said moguls are deformed by the weight and walking action of the wearer;

a footbed positioned over said midsole and comprising a flexible and resilient body member having a plurality of spaced, raised cushioning elements on the upper surface thereof, said footbed having a front portion with a plurality of spaced apertures therethrough, said spaced apertures being substantially vertically aligned with some or all of said midsole holes to enable air flow through said body member; and an upper extending over said footbed and midsole, said upper being secured to said outsole;

said footbed further comprises a flexible cover member surrounding said body member and conforming substantially to the shape thereof, said cover member having a front portion with a plurality of spaced apertures therethrough that are substantially vertically aligned with the spaced apertures in said body member, said body member having a thickness of approximately 6 millimeters and said raised cushioning elements have a height of approximately 6 millimeters above the upper surface thereof.

2. The footwear construction of claim 1 wherein said midsole has a rear portion that is reinforced for additional support.

3. The footwear construction of claim 2 wherein said rear portion of said midsole is reinforced by an elongated shank of a rigid material mounted therein.

4. The footwear construction of claim 3 wherein said shank extends forwardly to a point just rearwardly of the ball of the foot of the wearer.

5. The footwear construction of claim 1 wherein said outsole has a rear portion with a plurality of depending moguls on the bottom surface thereof.

6. The footwear construction of claim 1 wherein said body member is formed of a polyurethane foam.

7. The footwear construction of claim 1 wherein said cushioning elements are substantially uniformly spaced on the upper surface of said body member at a spacing of approximately 10–30 millimeters.

8. The footwear construction of claim 1 wherein said raised cushioning elements are generally curved in shape.

9. The footwear construction of claim 1 wherein said mogul are generally curved in shape.

10. The footwear construction of claim 9 wherein said moguls are substantially uniformly spaced on the front portion of said outsole and are approximately from 4 to 12 millimeters in depth from the bottom surface of said outsole.

11. The footwear construction of claim 10 wherein said moguls are approximately from 15 to 22 millimeters in width.

12. The footwear construction of claim 11 wherein said moguls are approximately from 2.5 to 4 millimeters in thickness.

* * * * *